US006926186B2

(12) United States Patent
Wells

(10) Patent No.: US 6,926,186 B2
(45) Date of Patent: Aug. 9, 2005

(54) FASTENER INSERTION DEVICE

(75) Inventor: Joe F. Wells, Newburgh, IN (US)

(73) Assignee: North American Green, Inc., Evansville, IN (US)

( * ) Notice: Subject to any disclaimer, the term of this patent is extended or adjusted under 35 U.S.C. 154(b) by 0 days.

(21) Appl. No.: 10/620,400

(22) Filed: Jul. 15, 2003

(65) Prior Publication Data

US 2004/0011847 A1 Jan. 22, 2004

Related U.S. Application Data

(60) Provisional application No. 60/397,547, filed on Jul. 22, 2002.

(51) Int. Cl.[7] ..... B25C 1/04

(52) U.S. Cl. ..... 227/129; 227/120; 227/130; 227/134; 227/147; 173/90

(58) Field of Search ..... 227/109, 130, 227/147, 119, 120, 136

(56) References Cited

U.S. PATENT DOCUMENTS 3,215,324 A * 11/1965 Dorney ..... 227/123
3,583,496 A * 6/1971 Fehrs ..... 173/15
3,677,456 A * 7/1972 Ramspeck et al. ..... 227/8
3,929,056 A * 12/1975 Lange ..... 91/461
4,084,738 A * 4/1978 Schneider ..... 227/7
4,139,136 A * 2/1979 Catalano ..... 227/109
4,549,344 A * 10/1985 Nikolich ..... 29/432
4,627,563 A * 12/1986 Meyer ..... 227/130
4,688,710 A * 8/1987 Massari et al. ..... 227/109
4,706,864 A * 11/1987 Jacobsen et al. ..... 227/109
4,815,647 A * 3/1989 Chou ..... 227/109
4,826,066 A 5/1989 Koester et al.
4,907,730 A * 3/1990 Dion ..... 227/8
5,025,969 A 6/1991 Koester et al.
5,485,946 A * 1/1996 Jankel ..... 227/8
5,556,020 A * 9/1996 Hou ..... 227/109

* cited by examiner

*Primary Examiner*—Stephen F. Gerrity
*Assistant Examiner*—Thanh Truong
(74) *Attorney, Agent, or Firm*—Barnes & Thornburg LLP

(57) ABSTRACT

A fastener insertion device includes an actuator that is either pneumatic or manually operated. The fastener insertion device is illustratively configured to receive either a staple magazine or a stake magazine. The stake magazine can house stakes of different dimensions. The pneumatic actuator includes a charging chamber and a control apparatus. The control apparatus comprises two valves, and is disposed between the charging chamber and a pneumatic cylinder.

20 Claims, 5 Drawing Sheets

FASTENER INSERTION DEVICE

CROSS-REFERENCE TO RELATED APPLICATIONS

This application claims the benefit of U.S. Ser. No. 60/397,547 filed Jul. 22, 2002.

BACKGROUND AND SUMMARY

The present disclosure relates generally to a tool used to drive fasteners such as staples, stakes, or other objects into the ground.

A fastener insertion device includes a guide having a drive member which reciprocates therein, and a fastener-holding magazine for supplying fasteners to the guide. The fastener insertion device illustratively comprises either a pneumatic actuator or a manually operated actuator, or both interchangeably. Furthermore, the illustrative fastener-holding magazines may be interchangeable so that fasteners of different types, including staples and stakes of various sizes, may be utilized in the device.

The fastener insertion device comprises one or more of the following features, elements or combinations thereof: an actuator is provided, the actuator being either pneumatic or manually operated. The fastener insertion device is illustratively configured to receive either a staple magazine or a stake magazine. The stake magazine houses stakes of different dimensions. The pneumatic actuator includes a charging chamber and a control apparatus. The control apparatus comprises two valves, and is disposed between the charging chamber and a pneumatic cylinder. The control apparatus controls whether compressed air is directed toward an upper portion of the pneumatic cylinder or a lower portion of the pneumatic cylinder. Illustratively, both valves are actuated in order to move the pneumatic cylinder. Compressed air biases the pneumatic cylinder in the uppermost position, and a spring biases the manually operated actuator in the uppermost position.

Additional features of the disclosure will become apparent to those skilled in the art upon consideration of the following detailed description of preferred embodiments exemplifying the best mode of carrying out the invention as presently perceived.

DETAILED DESCRIPTION OF THE DRAWINGS

Figure 1:
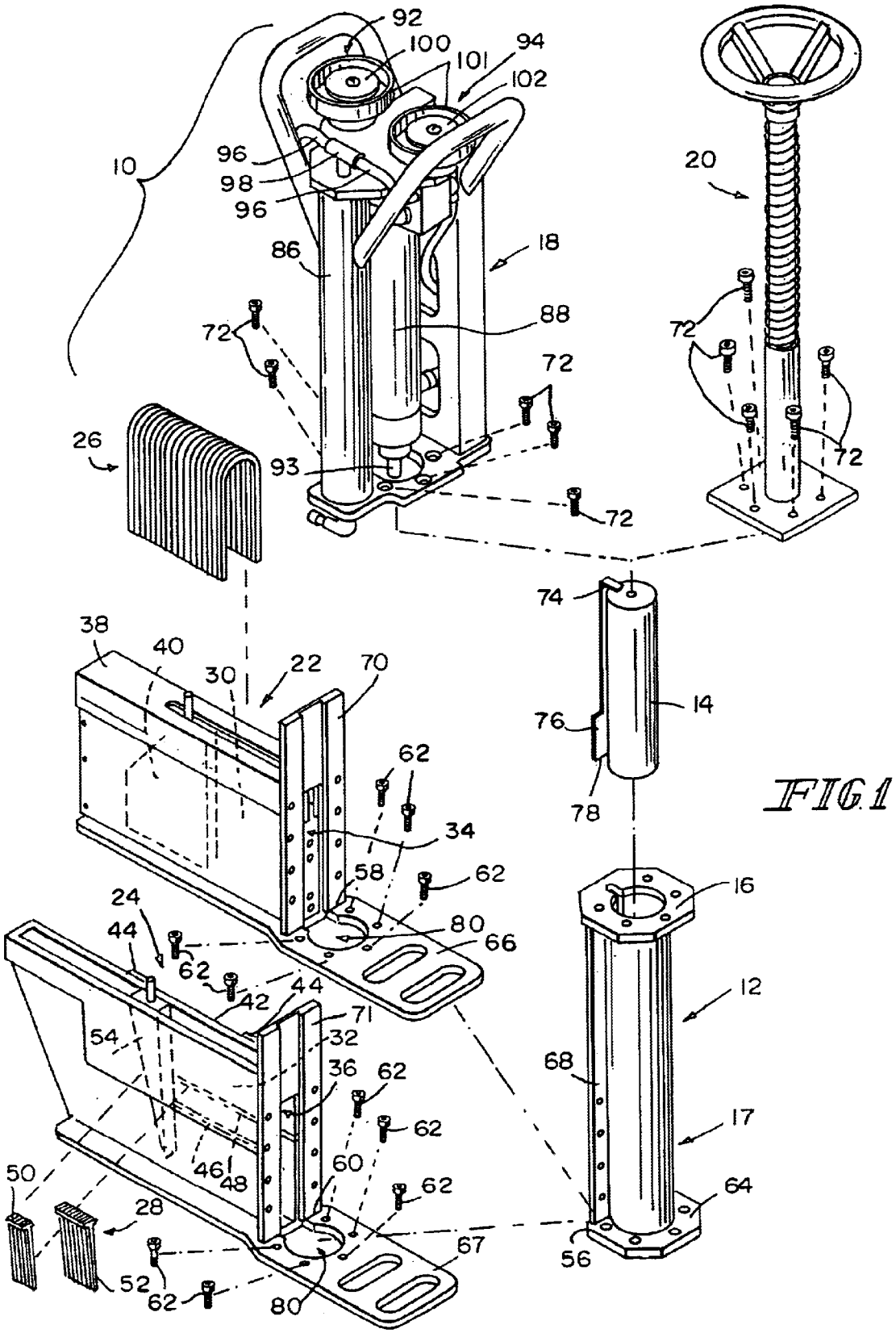
FIG. 1 shows a fastener insertion device according to the disclosure, wherein the device includes interchangeable actuators and interchangeable fastener magazines.
Figure 2:
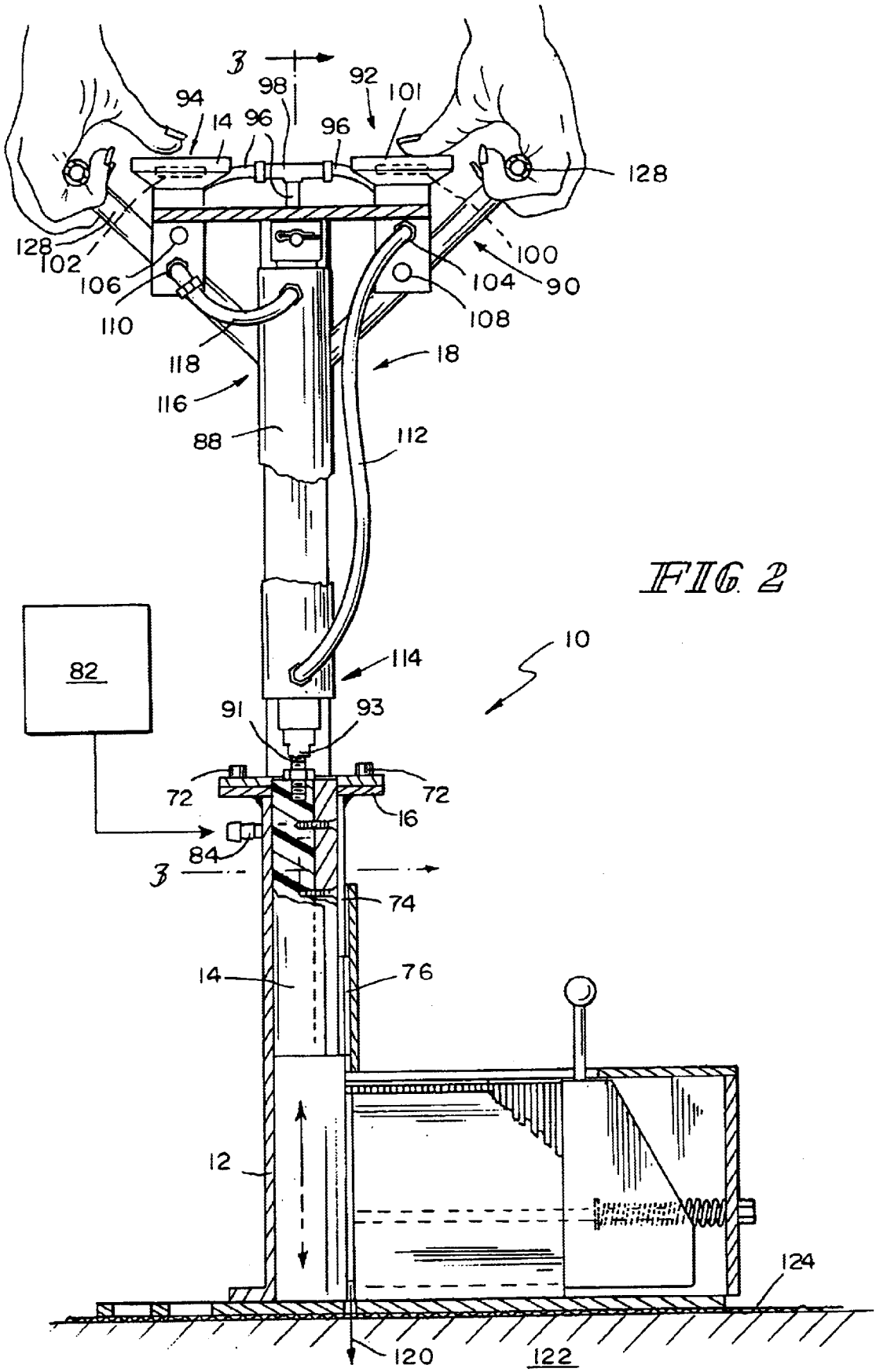
FIG. 2 is a side elevation view of one embodiment of the present disclosure, wherein a pneumatically actuated drive member drives a fastener (illustratively a staple) into the ground.
Figure 3:
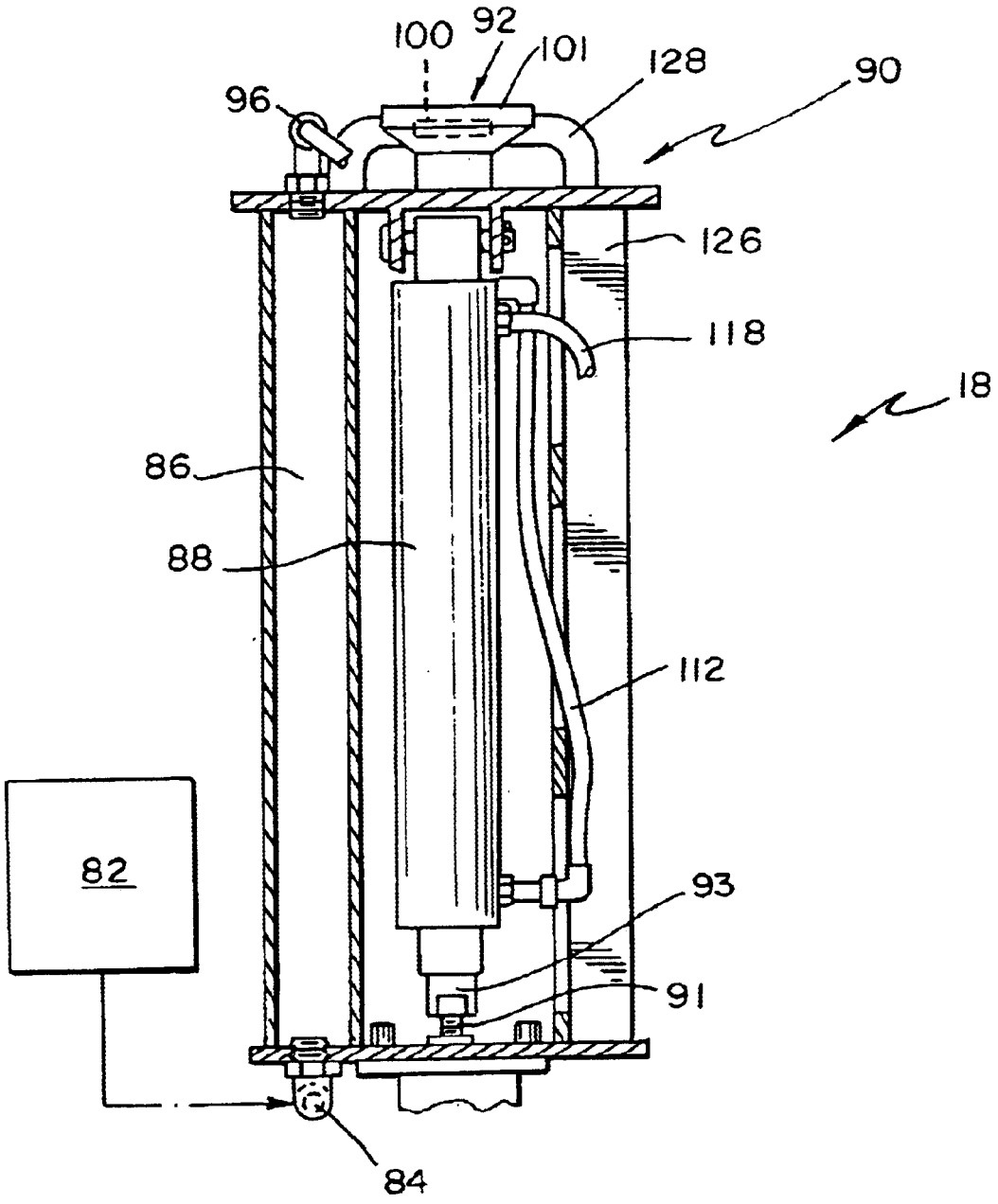
FIG. 3 is a sectional view taken along the line 3—3 of FIG. 2, showing a centralized pneumatic cylinder and showing a charging chamber in pneumatic communication with the cylinder.
Figures 4, 5:
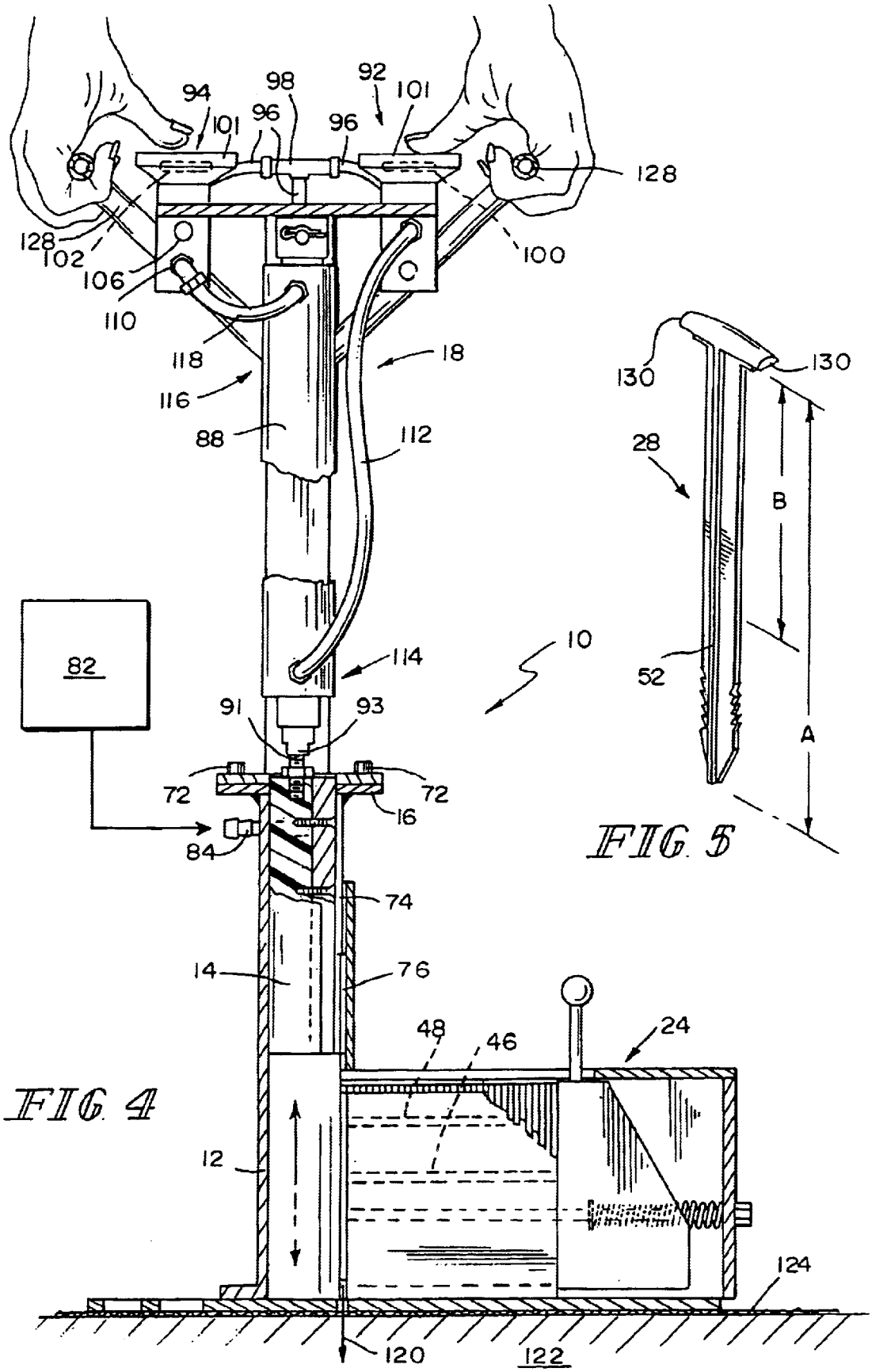
FIG. 4 is a side elevation view of another embodiment of the present disclosure, showing a stake magazine coupled to the fastener insertion device.
FIG. 5 is a perspective view of a stake used in conjunction with the fastener insertion device shown in FIG. 4.

A fastener insertion device 10 is shown in FIG. 1 to include a guide 12 having a reciprocating drive member 14 configured to move relative to guide 12. Top end 16 of guide 12 is formed to receive one of either of actuators 18, 20. Pneumatic actuator 18, described in more detail below, is configured to move drive member 14 by pneumatic pressure, illustratively compressed air, as shown in FIGS. 2–4. Alternatively, manually operated actuator 20, shown in FIG. 6, can be coupled to top end 16 of guide 12 for actuation by an operator.

Fastener insertion device 10 is further illustratively configured to accommodate interchangeable fastener magazines 22, 24, as shown in FIG. 1. Illustratively, magazine 22 is configured to house staples 26. Magazine 24 is illustratively configured to house stakes 28. Each of magazines 22, 24 is configured to feed the associated fastener (staple 26 or stake 28) adjacent to guide 12, wherein the staple 26 or stake 28 is driven out of the fastener insertion device 10 and into the ground or other surface. Typically, such a use might be to insert the fastener into ground, thereby holding an object such as an erosion control blanket or other material on the ground, as will be discussed infra. It should be understood that other magazines for housing other fasteners are within the scope of the disclosure and would require minimal, if any, modifications to the fastener insertion device 10.

Magazines 22, 24 operate in substantially the following manner. Staples 26 and stakes 28 are aligned and loaded into chambers 30, 32 of respective magazines 22, 24. Staple magazine 22 is illustratively loaded with staples 26 by removing or pivoting top door 38, top-loading staples 26 in chamber 30, and replacing top door 38. Illustratively, staple magazine 22 includes a pusher 40 which is spring biased in order to keep staples 26 in position to be fed through door 34 into guide 12.

Stake magazine 24 is similarly constructed. A side door 42 having latches 44 is opened in order to load stakes 28 into chamber 32. Grooves 46, 48 are formed in the inside walls of chamber 32. Grooves 46 are illustratively formed to accommodate a four inch stake 50. Grooves 48 are illustratively formed to accommodate a six inch stake 52. It should be understood, however, that other sizes of stakes can be accommodated with only minimal revisions to stake magazine 24. Stake magazine 24 also illustratively includes a pusher 54 which is spring biased in order to keep stakes 28 in position to be fed through door 36 into guide 12. While the magazines 22, 24 have been disclosed as indicated above, other magazines and constructions are within the scope of the disclosure, and would need only minor modifications in order to mount them to guide 12.

Each of magazines 22, 24 is coupled to guide 12 in the following fashion. Corner 56 of guide 12 is selectively positioned in one of corners 58, 60 of magazines 22, 24. Bolts 62 secure bottom plate 64 to base 66, 67 of magazines 22, 24. Other bolts (not shown) secure rear plate 68 to vertical plate 70, 71 of magazines 22, 24.

The fastener insertion device 10 comprises a guide 12 with a top end 16 configured to receive either actuator 18 or 20 and a lower end 17 configured to couple to either magazine 22 or 24, the guide 12 having a vertically extending slot facing magazines 22 or 24. A drive member 14 is reciprocable in guide 12 and has a connector 74 projecting toward magazine 22 or 24.

One of either pneumatic actuator 18 or manually operated actuator 20 is selectively mounted to top end 16 of guide 12 with bolts 72. The operation of either actuator 18 or actuator 20, as discussed in more detail below, slidably moves drive member 14 relative to guide 12. Connector 74 radially extends from drive member 14 and fastener pusher 76 is coupled to connector 74. Illustratively, connector 74 is an elongated bar mounted on drive member 14 in such a manner that its shorter axis extends radially from drive member 14. Fastener pusher 76 is mounted orthogonally to connector 74, and bottom edge 78 of fastener pusher 76 is configured to contact a staple 26 or stake 28 that is presented through door 34 or door 36, corresponding to which magazine 22, 24 is selected. It is within the scope of the disclosure, however, to substitute other configurations for fastener pusher 76 and connector 74. For example, connector 74 may be a screw for connecting fastener pusher 76 to drive member 14. Although drive member 14 and guide 12 are illustratively substantially cylindrical in shape, it is within the scope of the disclosure to have alternative configurations for drive member 14 and guide 12.

As drive member 14 and fastener pusher 76 move relative to guide 12 toward bottom plate 64, fastener pusher 76 contacts a fastener (illustratively either a staple 26 or stake 28) and moves the fastener through aperture 80 and into the underlying surface, such as ground, as shown in FIGS. 2 and 4.

An assembled fastener insertion device 10 having a pneumatic actuator 18 for driving staples 26 into the ground 122 is shown in FIG. 2. A compressed air source 82 supplies compressed air to inlet 84. Inlet 84, as can be seen in FIG. 3, directs air into charging chamber 86. Charging chamber 86 functions as a reservoir for holding compressed air prior to its release into pneumatic cylinder 88 via control apparatus 90. Pneumatic cylinder 88 is illustratively a cylinder having a piston (not shown) and plunger 93 housed within. The piston and plunger 93 move relative to pneumatic cylinder 88 in response to the pressurization of air inside the cylinder 88. The plunger 93 is coupled to drive member 14 via bolt 91.

Control apparatus 90 illustratively operates in the following fashion. Control apparatus 90 comprises a first valve 92 and a second valve 94, as can be seen in FIG. 2. Compressed air flows from charging chamber 86 (not visible in FIG. 2) to each valve 90, 92 through tubing 96 and "T" 98. Each of valves 92, 94 includes a button 100, 102 that can be moved (i.e. by a thumb of an operator) between a biased default (non-depressed) position and a depressed position. Valves 92, 94 function to direct compressed air either to an upper exit port 104, 106, or to a lower exit port 108, 110. When valves 92, 94 are in the default position shown in FIG. 1, compressed air is directed through respective upper exit ports 104, 106. Accordingly, when valves 92, 94 are in the depressed position, compressed air is directed through respective lower exit ports 108, 110.

Illustratively, exit ports 106, 108 are capped and no tube extends therefrom. Upper exit port 104 is in pneumatic communication via tube 112 with a lower portion 114 of pneumatic cylinder 88. Lower exit port 110 is in pneumatic communication via tube 118 with upper portion 116 of pneumatic cylinder 88. During the default state, when buttons 100, 102 are biased in their default, non-depressed positions, first valve 92 directs compressed air to lower portion 114 of pneumatic cylinder 88, thereby biasing cylinder 88 in the recessed, uppermost position, and accordingly positioning drive member 14 in the uppermost position, as shown in FIG. 2. Also during this default state, second valve 94 allows tube 118 to be vented to the atmosphere through a breathe port (not shown), thereby preventing the buildup of compressed air in upper portion 116 of pneumatic cylinder 88.

When button 100 is depressed, first valve 92 no longer directs compressed air to lower portion 114 of pneumatic cylinder 88, and instead tube 112 is vented to the atmosphere through first valve 92 via a breathe port (not shown), thereby allowing compressed air to escape from lower portion 114 of pneumatic cylinder 88. When button 102 is depressed, compressed air is directed to upper portion 116 of pneumatic cylinder 88. If button 100 is simultaneously depressed with button 102, the piston (not shown) and plunger 93 of cylinder 88 are urged to their extended positions. As noted above, the plunger 93 is coupled to drive member 14, therefore its movement into its extended position causes drive member 14 to move and fastener pusher 76 to contact a staple 26 (or in the case of FIG. 4, a stake 28) and move it in direction 120 into ground or substrate 122. Illustratively, an erosion control blanket or other fabric 124 is secured to the ground 122 with whichever fastener (staple 26 or stake 28) is desired.

It should be understood that while the illustrative embodiment provides for two valves 92, 94 which control the operation of cylinder 88, it is possible to utilize a single valve which alternates between a state of delivering compressed air to lower portion 114 of cylinder 88 and upper portion 116 of cylinder 88. However, the two-button embodiment as disclosed requires two buttons, rather than just one button, to be depressed in order to direct a fastener into the ground 122, and such an embodiment may be considered a desirable safety improvement. Another safety feature is the rims 101 encompassing first and second buttons 100, 102. Rims 101 are configured to extend above first and second buttons 100, 102 such that buttons 100,102 may not be accidentally depressed, for example, by an operating leaning on them.

FIG. 3 is a sectional view of the control apparatus 90, pneumatic cylinder 88 and charging chamber 86 taken along the line 3—3 of FIG. 2. As described above, compressed air from compressed air source 82 is directed into charging chamber 86 via inlet 84. Tubing 96 directs the compressed air from charging chamber 86 into "T" 98 (shown in FIG. 2) and into both valves 92, 94 (only first valve 92 is shown in FIG. 3). A frame member 126 provides additional structure to pneumatic actuator 18. Handles 128 are mounted on frame member 126 on one end and charging chamber 86 on the other end, illustratively by a welding process. Handles 128 assist an operator in manipulating and operating the fastener insertion device 10.

A fastener insertion device 10 having a stake magazine 24 coupled thereto is shown in FIG. 4, and an illustrative stake 28 is shown in FIG. 5. The fastener insertion device 10 of FIG. 4 is substantially identical to that shown in FIG. 2, with the exception of stake magazine 24 being coupled to guide 12. Stake magazine 24 is formed to include grooves 46, 48 for accommodating differently sized stakes 28, as represented in FIG. 5. Illustratively, a stake 52 having a dimension A of six inches is positioned in stake magazine 24 such that each of guide ends 130 of stake 52 is guided by grooves 48. Alternatively, a four-inch stake 50 (shown in FIG. 1) having a dimension B may similarly be guided by grooves 46.

Figure 6:
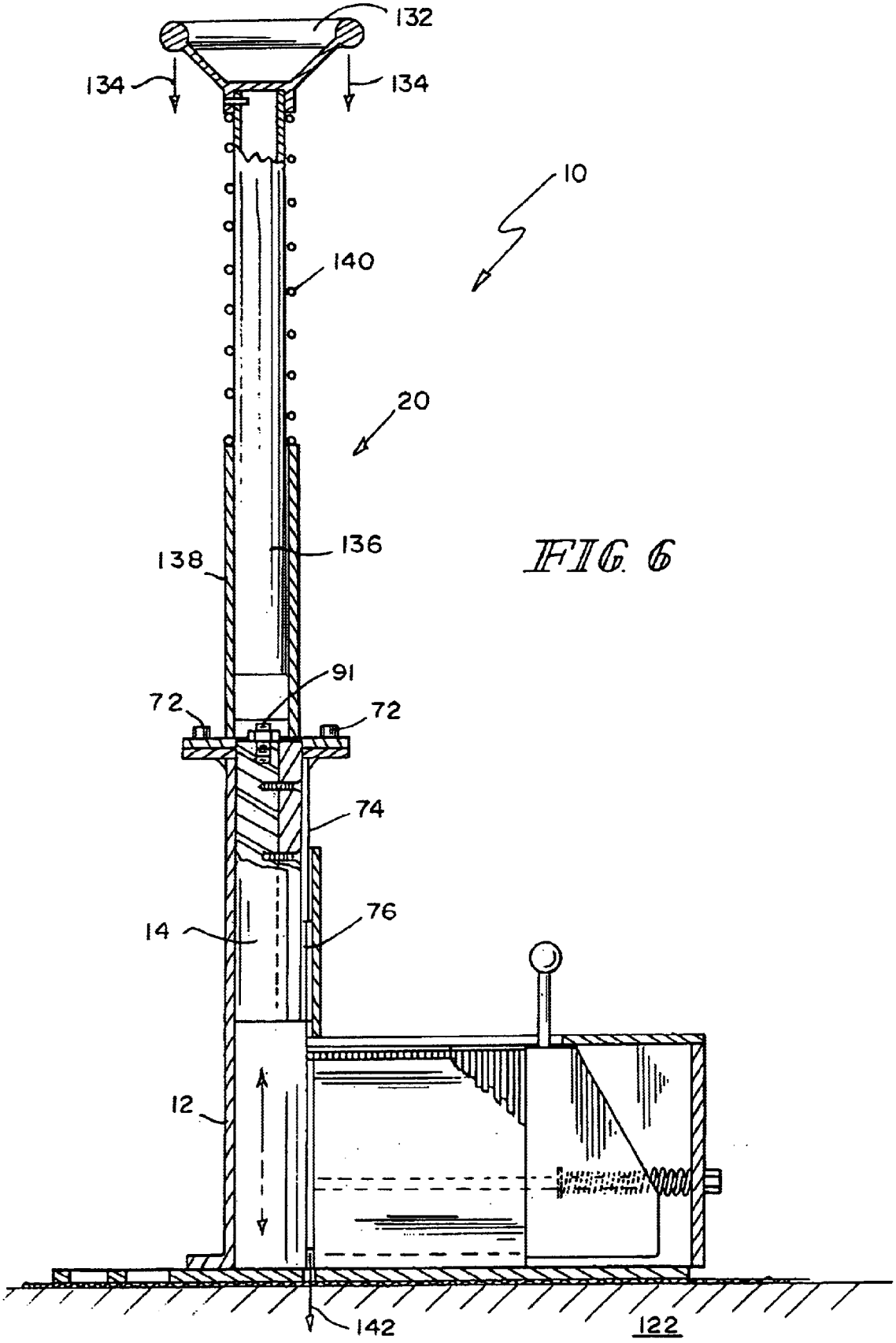
FIG. 6 is a side elevation view of yet another embodiment of the present disclosure, showing a manually operated actuator for driving the fastener into the ground.

Another embodiment of fastener insertion device 10 is shown in FIG. 6, wherein fastener insertion device utilizes a manually operated actuator 20 to drive staples 26 or stakes 28 into the ground 122. Illustratively, manually operated actuator 20 includes a handle 132 configured to be moved in a downwardly direction 134 such that plunger 136 moves relative to sleeve 138. Plunger 136 is coupled to drive member 14 via bolt 91 such that drive member 14 moves in conjunction with plunger 136. Manually operated actuator 20 also illustratively includes a spring 140 disposed between handle 132 and sleeve 138, the spring biasing handle 132 away from sleeve 138, thereby retaining drive member 14 in the uppermost position where it is ready to engage a fastener. Sleeve 138 is illustratively coupled to guide 12 with bolts 72.

During operation, a user transfers some of his body weight to handle 132, thereby causing handle 132 to move downwardly in direction 134. Handle 132 causes plunger 136 to move relative to sleeve 138, and thereby to move drive member 14 relative to guide 12. As fastener pusher 76 moves downwardly, it engages a fastener and expels it in direction 142 into ground 122. When the user's weight is lifted or removed from handle 132, spring 140 causes handle 132, and likewise plunger 136 and drive member 14, to return to their uppermost positions, at which point the process can be repeated.

It should be understood that while the illustrative embodiment utilizes a spring 140 to bias handle 132 in the uppermost position, it is within the scope of the disclosure to have other configurations that may utilize, for example, a system having compressed gas that biases handle 132.

What is claimed is:

1. A kit for inserting a fastener into a substrate, the kit comprising a guide, a fastener holder couplable to the guide and configured to hold a plurality of fasteners, a fastener pusher coupled to the guide for movement relative to the fastener holder between a retracted position and an extended fastener-inserting position, the fastener pusher being configured to engage an end of a fastener, a pneumatic actuator couplable to the guide, the pneumatic actuator being driven by compressed gas to move the fastener pusher between the extended fastener-inserting position and the retracted position, and a manual actuator couplable to the guide, the manual actuator being manually operable to move the fastener pusher from the retracted position to the extended fastener-inserting position.

2. The kit of claim 1, wherein the fastener holder is exchangeable with a second fastener holder.

3. The kit of claim 1, wherein the manual actuator includes a handle and an operator-driven piston coupled to the handle.

4. The kit of claim 1, wherein the pneumatic actuator includes a control apparatus, and the control apparatus includes a pneumatic valve.

5. The kit of claim 4, wherein the control apparatus includes two pneumatic valves.

6. The kit of claim 5, wherein the two pneumatic valves have a first default position and a second position.

7. The kit of claim 6, wherein the pneumatic actuator is actuated when the two pneumatic valves are both in their second position.

8. A fastener insertion kit for inserting fasteners in a substrate or in the ground, the insertion kit comprising:

a guide, a magazine couplable to the guide, the magazine being configured to hold a plurality of fasteners and having an opening through which the fasteners are fed;

a drive member coupled to the guide, the drive member being moveable in a first direction across the opening of the magazine to drive a fastener into the substrate or the ground, and moveable in an opposite second direction across the opening, a pneumatic actuator couplable to the guide, the pneumatic actuator being operable to move the drive member in the first direction, and a manual actuator couplable to the guide, the manual actuator being manually operable to move the drive member in the first direction.

9. The kit of claim 8 wherein the pneumatic actuator includes:

a pneumatic cylinder having an upper portion and a lower portion, the pneumatic cylinder being in fluid communication with a source of compressed gas; and a piston having an upper end and an opposite lower end, the piston being disposed within the cylinder and moveable relative thereto, and the piston being coupled to the drive member.

10. The kit of claim 9 wherein the pneumatic actuator further comprises a charging chamber in fluid communication with both the source of compressed gas and with the pneumatic cylinder.

11. The kit of claim 10 wherein the pneumatic actuator further comprises a control apparatus in fluid communication with the charging chamber and the pneumatic cylinder and configured to control the introduction of compressed gas into the pneumatic cylinder.

12. The kit of claim 11 wherein the control apparatus is disposed between the charging chamber and the pneumatic cylinder.

13. The kit of claim 12 wherein the control apparatus comprises a first valve configured to direct compressed gas into the upper portion of the pneumatic cylinder to drive the piston in the first direction and a second valve configured to direct compressed gas into the lower portion of the pneumatic cylinder to drive the piston in the second direction.

14. The kit of claim 13, wherein both valves must be actuated in order to move the piston in the pneumatic cylinder.

15. The kit of claim 14, wherein the valves comprise buttons which are actuated by applying pressure thereto.

16. The kit of claim 8, wherein the magazine is removable and is configured to house fasteners of different dimensions.

17. The kit of claim 16, wherein the fasteners comprise staples.

18. The kit of claim 16, wherein the fasteners comprise stakes.

19. The kit of claim 8 wherein the manual actuator includes:

a handle coupled to the drive member and operable alone or with the aid of the compressed gas to move the drive member in the first direction, and a spring bias disposed between the handle and the drive member and operable alone or with the aid of the compressed gas to move the drive member in the second direction.

20. A fastener insertion kit for inserting fasteners in a substrate or in the ground, the insertion kit comprising:

a guide, a magazine couplable to the guide, the magazine being configured to hold a plurality of fasteners and having an opening through which the fasteners are fed;

a drive member coupled to the guide, the drive member being moveable in a first direction across the opening of the magazine to drive a fastener into the substrate or the ground, and moveable in an opposite second direction across the opening, a pneumatic actuator couplable to the guide, the pneumatic actuator including:

a pneumatic cylinder having an upper portion and a lower portion, the pneumatic cylinder being in fluid communication with a source of compressed gas;

a piston having an upper end and an opposite lower end, the piston being disposed within the cylinder and moveable relative thereto;

the drive member being coupled to the piston and moveable therewith in the first direction across the opening of the magazine by the compressed gas entering the upper portion of the pneumatic cylinder to drive a fastener into the substrate or the ground, and moveable in an opposite second direction across the opening by the compressed gas entering the lower portion of pneumatic cylinder, and a manual actuator couplable to the guide, the manual actuator being manually operable to move the drive member in the first direction.

* * * * *